United States Patent [19]

Burton

[11] Patent Number: 4,572,064

[45] Date of Patent: Feb. 25, 1986

[54] BRUSH BUNDLING SYSTEM

[76] Inventor: R. Edward Burton, 23881 Sherwood Rd., Willits, Calif. 95490

[21] Appl. No.: 613,096

[22] Filed: May 23, 1984

[51] Int. Cl.[4] ..... B65B 13/20

[52] U.S. Cl. ..... 100/8; 100/3; 100/100; 100/212

[58] Field of Search ..... 100/1, 3, 8, 100, 30, 100/212; 188/6; 104/183

[56] References Cited

U.S. PATENT DOCUMENTS

| | | | |
|---|---|---|---|
| 511,917 | 1/1894 | Thomas | 100/212 |
| 564,910 | 7/1896 | Ashbaugh | 100/1 |
| 813,646 | 2/1906 | Grill | 100/212 |
| 831,908 | 9/1906 | Tusar | 104/183 X |
| 1,472,727 | 10/1923 | McNames | 188/6 |
| 3,395,637 | 8/1968 | Larsson | 100/212 |
| 3,742,842 | 7/1973 | Pierens | 100/212 |

*Primary Examiner*—Billy J. Wilhite

*Attorney, Agent, or Firm*—Flehr, Hohbach, Test, Albritton & Herbert

[57] ABSTRACT

A brush bundling system including an elongated vertical frame; and at least one long strap fastened at one end to the frame and adapted to be extended along the ground a long distance behind the frame to enable a large volume of cut brush to be piled thereon. A tensioning arrangement is mounted on the frame and adapted to be fastened to the free end of said strap for pulling said strap around said volume of cut brush to compress said brush into a tight bundle, whereupon said compressed bundle may be strapped with a steel strap or other strapping or tying material to retain the bundle in its compressed state.

18 Claims, 5 Drawing Figures

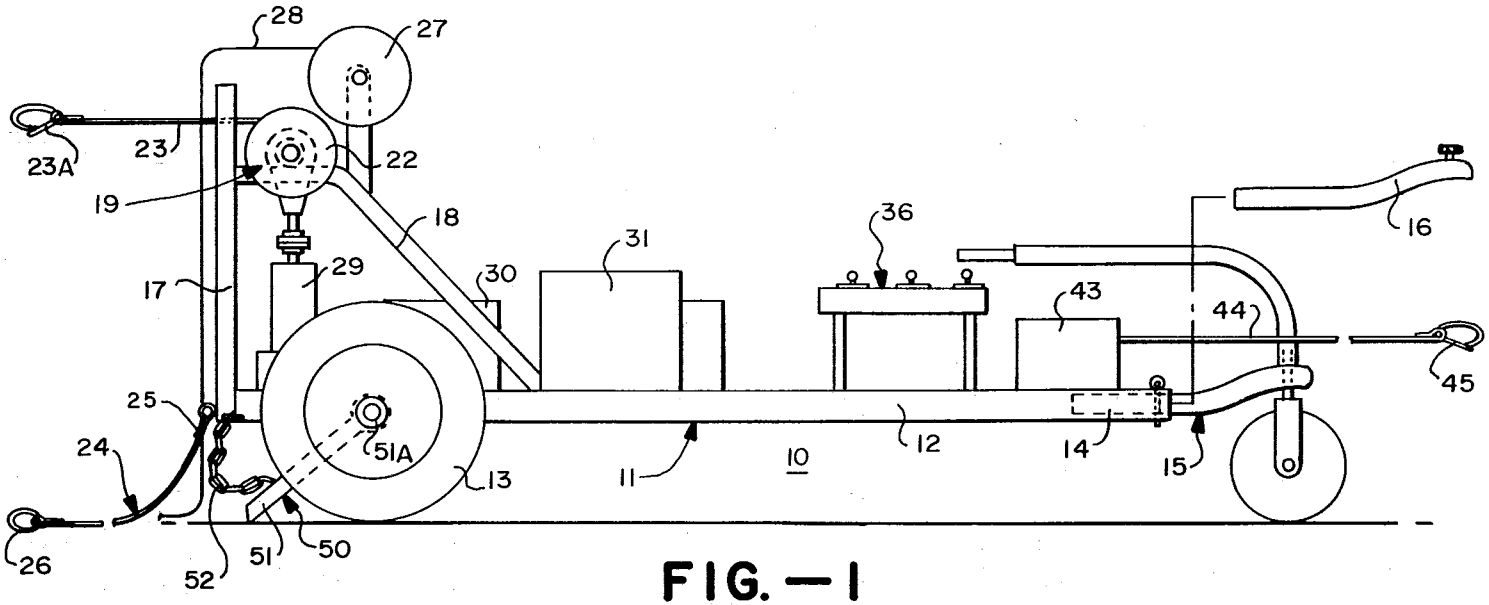
FIG. — 1
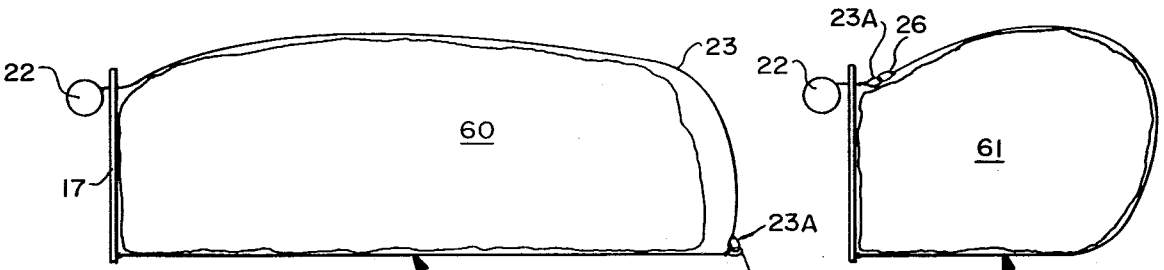
FIG. — 4
FIG. — 5

BRUSH BUNDLING SYSTEM

This invention relates generally to systems for bundling cut brush and small trees and forest waste products.

It has been demonstrated in various parts of the United States, such as the Great Lakes states and the South, that harvesting and chipping brush to use for fuel can be a profitable operation. In areas where the terrain permits, costly high volume production equipment, creating a hundred tons of chips per hour, is feasible. However, in many areas of the country, such expensive high volume equipment cannot be utilized either because of the terrain or the size of the brush or the type of land management that needs to be practiced. In addition, large wood chip vans cannot negotiate narrow ranch and logging roads in many parts of the country. Accordingly, there is a need for a relatively inexpensive approach to harvesting brush and forest waste products that can be used on a variety of types of terrain.

An important component of a low cost approach is a brush bundling system which can be operated in rugged terrain and can easily be managed with manual operation by a team of two or three persons. Over the past five years, a number of systems for compacting and bundling brush have been tried. Some of these systems have employed compression rolls, strapping machines, folding hydraulic arms, and clamp and advancing systems. None of these systems had been successful for a variety of different reasons.

Accordingly, the principal object of this invention is to provide an improved brush bundling system.

It is specifically an object of this invention to provide a brush bundling system which will effectively compact and bundle brush and can be used on a variety of terrains.

In its most general aspect, this invention features a brush bundling system which utilizes an elongated vertical frame and at least one long strap fastened at one end to the frame and adapted to be extended along the ground a long distance behind the frame to enable a large volume of cut brush to be piled on the strap. A tensioning means mounted on the frame is adapted to be fastened to the free end of the strap for pulling the strap around the volume of cut brush to compress the brush into a tight bundle whereupon the compressed bundle may be strapped with steel strap or other strapping or tying material to retain the bundle in its compressed state.

Preferably, at least a pair of long straps are fastened to the frame and adapted to be extended along the ground behind the frame to pile the brush thereon. It is also preferable that the tensioning means be motor driven and utilize a pair of strap reels rotatably mounted to the frame and positioned generally in vertical alignment with the fastening point for the other pair of straps.

A long strap carried on each of the reels has a free end adapted to be extended over a pile of brush and to be attached to the free end of a corresponding one of the ground straps. A motor drive means drives each of the strap reels to wind up the strap carried thereon and thereby compress the bundle of brush against the frame.

In a preferred embodiment the strap reels are mounted on an axle communicating with a differential gear mounted to the frame. A motor is mounted to the frame and connected in driving relation to the differential gear for driving the strap reels in an independent fashion. In this manner the individual reels can tighten the strap around the brush bundle with independent compression force exerted on each strap. It is also preferable that a pair of strap reels carrying steel strapping be provided on the frame for strapping the brush bundle after it is compressed.

The system of this invention may alternatively be constructed such that it may be fastened to and carried on a three-point hitch on the rear end of a tractor or mounted on a wheeled trailer. Alternatively, the system may be carried on the back of a jeep or any vehicle capable of negotiating the terrain. In embodiments in which the frame is constructed and arranged to be fastened to a three-point hitch on the rear end of a tractor, it is preferable that the motor utilized to drive the differential gear be a hydraulic motor adapted to be coupled to the hydraulic power system of the tractor.

In an embodiment where the frame is carried on the back end of a wheeled trailer, it is preferable to use an electric motor to drive the differential gear. The electric motor may be powered by a battery which can be regularly charged by a motor-generator system. The wheeled trailer preferably includes at least one electric winch mounted on a front portion of the trailer bed with a cable carried on the winch adapted to be extended in front of the trailer and mounted to a stationary object such that the winch may be operated to propel the trailer toward the object. A pair of winches may be used on the trailer for alternate attachment to stationary objects at different locations on a hillside for enabling the trailer to be pulled by the winches up a rather steep incline.

The brush bundling system of this invention has the advantage that a relatively large volume of brush may be handled and compressed to a relatively tight bundle before tying or strapping. Using a motor driven tensioning means permits two-ton pull to be exerted on the brush compressing straps, thereby to compress an eighteen foot by six foot pile of brush to a six foot diameter weighing over two tons. In an area of good brush and small trees, two men can cut and bundle a two-ton bundle of brush in about thirty minutes. Accordingly, the brush bundling system of this invention enables the efficient harvesting of brush, thereby improving the land from which the brush has been removed and earning an income from the fuel material which is harvested.

Other objects, features, and advantages of this invention will be apparent from a detailed description of several embodiments of the invention which is set forth below in conjunction with the accompanying drawings.

FIG. 1 is an elevational view of one embodiment of a brush bundling system in accordance with this invention.

FIGS. 4 and 5 are schematic diagrams showing the operation of the brush bundling system of this invention.

Figure 2:
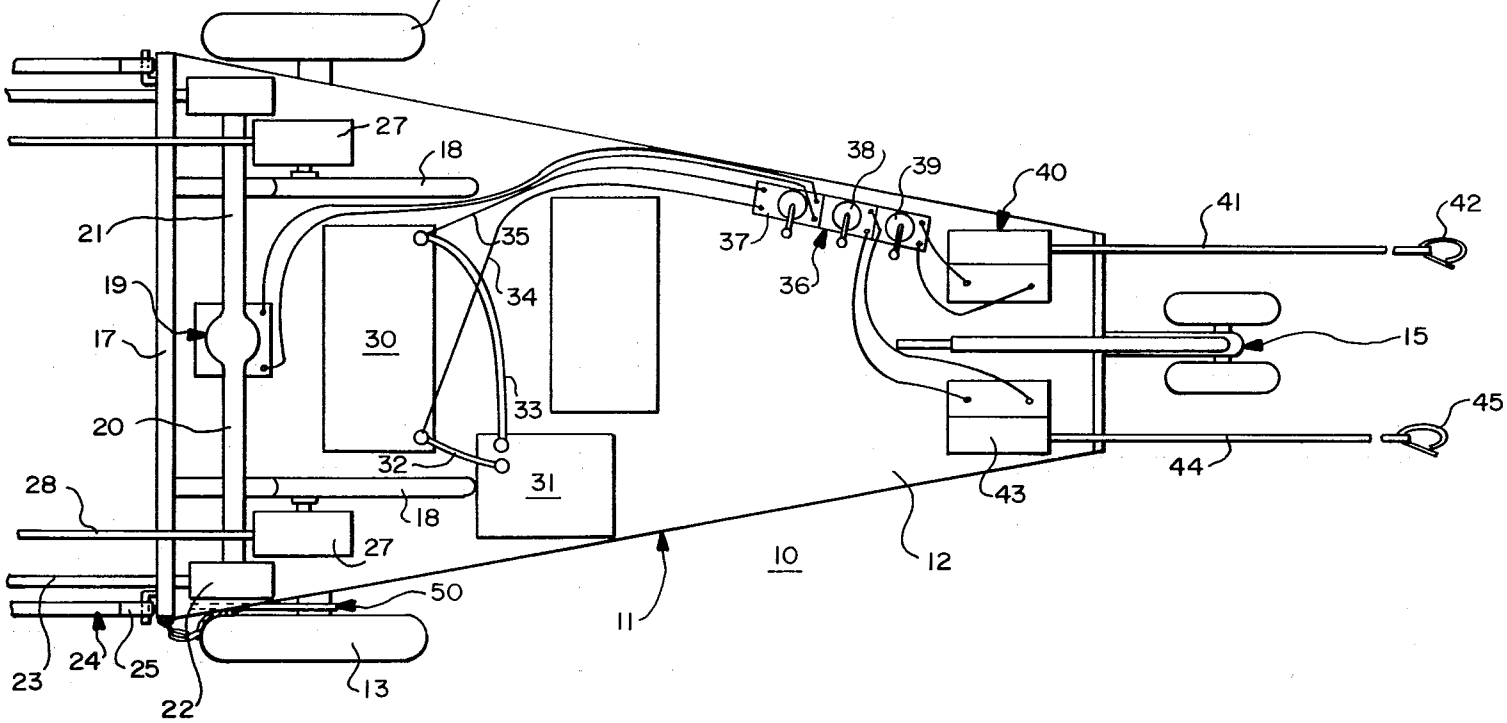
FIG. 2 is a top plan view of the brush bundling system depicted in FIG. 1.

Referring now to FIGS. 1 and 2, one embodiment of the brush bundling system in accordance with this invention which utilizes a wheeled trailer arrangement will be described. Brush bundling system 10 includes wheeled trailer 11 which basically consists of a horizontal trailer bed 12, a pair of rear wheels 13, and a slip coupling 14 which is adapted to receive alternatively a wheel and steering tiller assembly 15 or a standard trailer hitch 16. An elongated vertical frame 17 is mounted at the rear end of trailer bed 12 and extends three to five feet above the top of trailer bed 12. Frame bracing elements 18 serve as a mounting platform for a differential gear and axle arrangement 19 which includes a pair of axles 20 and 21. At each end of the two axles a strap reel 22 is mounted and carries a strap 23 with a hook arrangement 23A on the free end thereof. Another strap 24 is mounted at one end 25 to frame 17 using a suitable mounting arrangement and carries on its free end a hook 26. Steel strap reels 27 are mounted in a suitable fashion adjacent the strap reels 22 and carry a length of steel strapping 28.

The differential gear and axle arrangement 19 is driven by an electric motor 29 which is powered by a deep discharge, heavy duty storage battery 30. A hand powered winch could also be used. A motor-generator combination 31 provides electric power for charging the battery 30. The battery 30 is coupled by way of lines 34 and 35 to a control switch arrangement 36. Control switch arrangement 36 includes a first control switch 37 which controls operation of the electric motor 29. Switch 38 controls the operation of an electric winch 43 and switch 39 controls the operation of an electric winch 40. Winch 40 carries a cable 41 with a clamp 42 on its free end. Winch 43 carries a cable 44 with a clamp 45 on each free end.

A drag brake arrangement 50 is mounted to the rear axle of the wheeled trailer 11. A brake rod 51 is rotatably mounted to the axle at point 51A and chain 52 is connected between the brake rod 51 and the trailer bed 12. This drag brake prevents the trailer from moving backward more than a foot or so since the brake rod 51 would stick in the ground as the trailer moves backward and assume a vertical position restrained by the chain 52. Thereafter, the trailer will not go back any further since the brake rod is not able to rotate any further.

The straps 24 may, for example, be made from a very strong nylon strapping material and are preferably about twenty feet long to extend a long distance along the ground behind the trailer 11. Similarly, the nylon straps 23 are twenty to twenty five feet in length so that they can be stretched over a bundle of brush piled on top of the straps 24. The operation of the system of FIGS. 1 and 2 is best described in conjunction with the schematic drawings in FIGS. 4 and 5.

First the lower straps 24 are extended along the ground behind the trailer 11. In addition, a similar length of steel strapping material 28 is unreeled and laid along the ground behind the trailer 11. A volume of brush 60 about twenty feet long and about six to eight feet high is then loosely piled on top of the nylon straps 24 and steel strapping 28. In addition to cut brush, small tree trunks up to eight or ten inches in diameter and decaying fallen tree trunks may be piled on the brush pile.

After the brush pile has been completed, the nylon straps 23 are extended over the brush pile 60 and the end clamp 23A is coupled to the end clamp 26. Then the electric motor 29 is operated using the switch 37 to wind up the straps 23 onto the reels 22, thereby to compress the bundle of brush 60 into a tight bundle 61 against the frame 17. Depending on the nature of the brush, the final compressed bundle 61 may have about a six-foot diameter. The differential gear and axle arrangement 19 is preferably driven by an electric motor through a gear reduction system if necessary so that the reels 22 will apply at least about two thousand pounds of pulling force on the straps 23.

After the brush bundle has been compressed, the steel straps 28 are placed around the entire bundle. A Signode tensioner ratchet may then, for example, be used to tension the steel straps around the compressed bundle and thereafter an appropriate clip may be mounted on the steel strapping and crimped so that the compressed brush bundle will be appropriate tied. Thereafter, the clamps 23A and 26 are released, the strap 24 may be laid back along the ground behind the trailer 11 and the bundle 61 may then be hauled away. If the trailer is on the hill, the bundle can simply be rolled down to the bottom of the hill. Alternatively, various hauling systems may be utilized to haul the compressed and tied bundles of brush away from the site.

The electric winch arrangements 40 and 43 permit the wheeled trailer 11 to be propelled up a relatively steep hillside by alternately attaching the cables 41 and 44 around tree trunks or stumps further up the hillside. The steering tiller arrangement 15 may be utilized to guide the trailer 11 as the winches 40 and 43 are operated. In this manner, the brush bundling system of this invention can be utilized in very rough terrain involving steep hillside slopes. Alternatively, with a regular trailer hitch 16 attached to the trailer, the whole arrangement can be hauled behind a four-wheel drive jeep or other vehicle and thus be used in a fairly rugged terrain.

Figure 3:
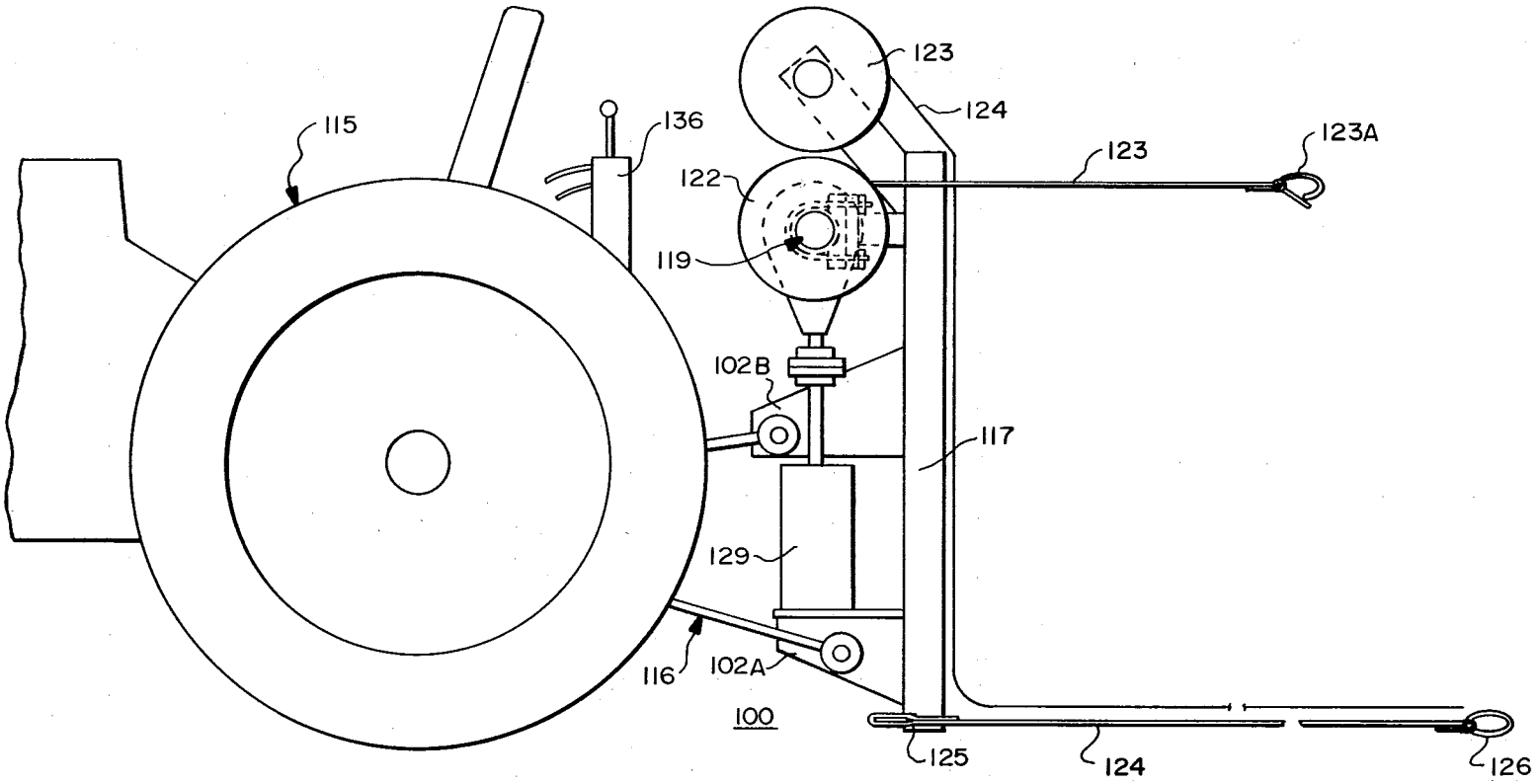
FIG. 3 is an elevational view of a second embodiment of a brush bundling system in accordance with this invention.

FIG. 3 illustrates an alternative embodiment of this invention in which the brush bundling system 100 may be carried on a three-point hitch arrangement 116 of a tractor 115. Mount supports 102A and 102B can carry the frame 17 to which is mounted the differential gear and axle arrangement 119 which carries the strap reels 122 on the axles thereof. All of the components of the tractor mounted brush bundling embodiment 100 which are similar to the trailer mounted system of FIGS. 1 and 2 are labeled with numbers in the 100 numbering system in a manner similar to the numbering system in FIGS. 1 and 2 for convenience of reference.

The system of FIG. 3 operates in a virtually identical fashion to the system of FIGS. 1 and 2 except that the motor 129 is preferably a hydraulic motor driven by the hydraulic power system of the tractor. In all other respects, the structure and operation is the same and thus a full description of the operation of the system of FIG. 3 need not be given at this point.

The brush bundling system of this invention enables the harvesting of brush for small scale fuel applications and other purposes. The overall procedures for using the systems of this invention in an integrated biomass recovery system are described in a paper by the present inventor entitled "Harvesting, Drying and Hauling of Brush for Small-Scale Fuel Applications" which was given at the following conference: Institute of Gas Technology International Symposium, Hotel Royal Playa, Lake Buena Vista, Fla., Jan. 30, 1984. This paper sets forth a description of the overall procedures involved in utilizing the brush bundling system of this invention, the economic considerations, and the costs potential revenues associated therewith. The contents of this paper are hereby incorporated specifically by reference for filling in background details on use of the invention in a practical biomass recovery system.

It should be understood that the above-described embodiments of this invention are given to illustrate the general principles of the invention and numerous modifications could be made by persons of skill in the art without departing from the principles and scope of the invention as claimed in the following claims.

I claim:

1. In a brush bundling system, an elongated vertical frame;

at least a pair of long straps fastened at one end to horizontally separated points on said frame and having free ends adapted to be positioned on the ground a long distance behind said frame to enable a large volume of cut brush to be piled on said straps;

a tensioning means mounted on said frame and adapted to be fastened to said free ends of said straps for pulling said straps around said volume of cut brush to compress said brush into a tight bundle, whereupon said compressed bundle may be strapped with a steel strap or other strapping or tying material to retain the bundle in its compressed state, said tensioning means comprising a pair of strap reels rotatably mounted to said frame at positions generally in vertical alignment with the fastening point for said pair of straps, a long strap carried on each of said strap reels and having a free end adapted to be extended over a pile of brush and to be attached to the free end of a corresponding one of said pair of straps, a motor drive means for driving each of said strap reels to wind up said strap carried thereon and thereby to compress said bundle of brush.

2. The system of claim 1, wherein said motor drive means comprises a differential gear and a pair of axles attached thereto, said gear and said axles being mounted to said frame, and a motor mounted to said frame and connected in driving relation to said differential gear; each of said strap reels being mounted on one of said axles and being driven by said motor through said differential gear.

3. The system of claim 2, wherein said frame includes mounting means for mounting said frame to a three-point hitch of a tractor and said motor is an hydraulic motor adapted to be coupled to the hydraulic power system of said tractor.

4. The system of claim 1, wherein a pair of strap reels are mounted to said frame for carrying steel strapping, whereby a free end of steel strapping from each reel may be extended along the ground behind said frame before forming said pile of brush and can thereafter be used to strap said brush bundle after it is compressed by said tensioning means.

5. The system of claim 1, wherein said frame includes mounting means for mounting said frame to a three-point hitch on the rear end of a tractor.

6. The system of claim 1, wherein said frame is carried on the back end of a wheeled trailer which includes a flat trailer bed, each of said strap reels being mounted on an axle communicating with a differential gear mounted to said frame, and an electric motor mounted on said trailer is connected in driving relation to said differential gear.

7. The system of claim 3, wherein said wheeled trailer includes a slip coupling on a front end of said trailer bed, said slip coupling adapted to receive alternatively a standard trailer hitch or a wheel and steering tiller assembly.

8. The system of claim 3, wherein said electric motor is powered by a battery, and further comprising a motor-generator system for regularly charging said battery.

9. The system of claim 3, further comprising at least one electric winch mounted on a front portion of said trailer bed with a cable carried on said winch adapted to be extended in front of said trailer and mounted to a stationary object such that said winch may be operated to propel said trailer toward said object.

10. The system of claim 9, wherein a pair of winches are mounted on a front portion of said trailer bed, each of said winches carrying a cable which may be extended in front of said trailer for alternate attachment to stationary objects at different locations on a hill side for enabling said trailer to be pulled by said winches up a hill.

11. The system of claim 9, further comprising a drag brake mounted to said trailer bed to preclude backward motion of said trailer down an incline upon any failure of said winch to hold said trailer on said incline.

12. A brush bundling system comprising an elongated vertical frame having a mounting means for mounting said frame to a three-point hitch on a tractor; at least a pair of long straps fastened at one end to horizontally separated points on said frame and having free ends adapted to be positioned on the ground a long distance behind said frame to enable a large volume of cut brush to be piled on said straps; and motor driven tensioning means comprising a differential gear and axle arrangement mounted on said frame, a pair of strap reels mounted on said axles of said differential gear and axle arrangement with a long strap carried on each of said strap reels and having a free end of each strap adapted to be extended over a pile of brush and to attach to said free end of a corresponding of one said other pair of straps, and motor means mounted to said frame and connected in driving relation to said differential gear for operating said strap reels independently to tighten up said straps thereon and thereby compress said bundle of brush whereupon said compressed bundle of brush may be strapped with steel straps or other strapping or tying material to retain the bundle in its compressed state.

13. The system of claim 12, wherein said motor is a hydraulic motor adapted to be coupled to the hydraulic power system of a tractor.

14. The system of claim 13, further comprising a pair of steel strap reels mounted to said frame for carrying steel strapping such that a free end of said steel strapping from each reel may be extended along the ground behind said frame before piling brush thereon and can thereafter be used to strap said brush bundle after it is compressed.

15. A brush bundling system comprising a wheeled trailer including flat trailer bed and an elongated vertical frame mounted on the rear end of said trailer bed; at least a pair of long straps fastened at one end to separated points on said trailer and having free ends adapted to be extended along the ground a long distance behind the said trailer to enable a large volume of cut brush to be piled on said straps; a differential gear and a pair of axles mounted on said trailer bed adjacent said frame; a pair of strap reels carried on said axles and a long strapping carried on each of said strap reels having a free end thereof adapted to be extended over a pile of brush and to attach to said free end of a corresponding one of said other pair of straps; an electric motor mounted on said trailer and connected in driving relation to said differential gear for operating said strap reels to tighten up said straps thereon and thereby to compress said bundle of brush.

16. The system of claim 15, further comprising at least one electric winch mounted on a front portion of said trailer bed with a cable on said winch adapted to be extended in front of said trailer and to be mounted to a stationary object such that said winch may be operated to propel said trailer toward said object.

17. The system of claim 15, wherein a pair of winches are mounted on a front portion of said trailer bed, each of said winches carrying a cable which may be extended in front of said trailer for alternate attachment to stationary objects at different locations on a hill side for enabling said trailer to be pulled by said winches up a hill.

18. The system of claim 15, wherein said wheeled trailer includes a slip coupling on a front end of said trailer bed, said slip coupling adapted to receive alternatively a standard trailer hitch or a wheel and steering tiller assembly.

* * * * *